US006000970A

United States Patent [19]

Wu

[11] Patent Number: 6,000,970

[45] Date of Patent: Dec. 14, 1999

[54] MINI JACK WITH IMPROVED GROUNDING CONTACT

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/057,082

[22] Filed: Apr. 8, 1998

[30] Foreign Application Priority Data

Apr. 8, 1997 [TW] Taiwan ..... 86205542

[51] Int. Cl.[6] ..... H01R 17/18

[52] U.S. Cl. ..... 439/669; 439/668

[58] Field of Search ..... 439/669, 668, 439/79, 947, 108

[56] References Cited

U.S. PATENT DOCUMENTS

| | | | |
|---|---|---|---|
| 3,435,163 | 3/1969 | Bailey et al. | 439/668 |
| 4,037,913 | 7/1977 | Deitch et al. | 439/668 |
| 4,978,310 | 12/1990 | Schichida | 439/668 |
| 5,338,215 | 8/1994 | Lee et al. | 439/668 |
| 5,634,819 | 6/1997 | Pam et al. | 439/947 |

*Primary Examiner*—Paula Bradley
*Assistant Examiner*—Tho D. Ta

[57] ABSTRACT

An electrical mini jack for electrically connecting an exterior pin plug to a circuit board, comprises a plurality of signal contacts, a grounding contact, an insulative housing and a base cover. The housing includes an inclined receiving portion and a hole formed together on opposite walls thereof. The grounding contact consists of a planar body portion, a tail portion extending through the base cover for soldering to an electrical circuit on the circuit board, a pair of positioning portions for orienting the contact in the housing and a spring arm perpendicularly bent with regard to the body portion for providing an increased elasticity to form a smooth contact area with the inserted pin plug. Since the spring arm of the grounding contact is received therein the receiving portion of the housing, the spring arm is located below or coplanar with an outer surface of the wall thereby avoiding the direct collision of exterior forces.

22 Claims, 6 Drawing Sheets

MINI JACK WITH IMPROVED GROUNDING CONTACT

BACKGROUND OF THE INVENTION

1. Field of the Invention

The present invention relates to a mini jack for use with an electrical apparatus, and particularly to a mini jack for electrically contacting a pin plug to a circuit board on which the mini jack is mounted.

2. The Prior Art

Conventional electrical jacks for receiving an external pin plug from an audibly or visibly input/output device, are equipped with a plurality of grounding contacts and signal contacts wherein each grounding contact is adapted to electrically connect the pin plug to a circuit board on which the electrical jack is mounted for providing the electrical engagement between the electrical jack and pin plug with a grounding protection when noise interference exists therein. A contact portion of such a grounding contact is generally fabricated by stamping to have a bifurcate configuration which is defined with a pair of coplanar and opposite arms and a narrow slot defined therebetween as disclosed in U.S. Pat. No. 4,846,719 and Taiwan Patent Application Nos. 78,204,014 and 78,204,013, however, the arms lack appropriate elasticity therein. Therefore, when the pin plug is forcedly inserted into the electrical jack to be clamped between the pair of arms of the contact portion, inner shear edges formed on each of the arms of the grounding contact via stamping process may directly scrape a plating layer on a surface of the pin plug or a permanent deformation is happened in the arms if the dimension of the narrow slot between the arms is less than that of the pin plug. Furthermore, the contact area on the shear edges of the arms for contacting with the pin plug is too small to ensure a sufficient and reliable engagement therewith.

Accordingly, to resolve the above disadvantages, an object of the present invention is to provide a mini jack which has a grounding contact with a spring arm functioning as a cantilever beam via a bending process for providing the connection with a pin plug with a higher elasticity thereby preventing the spring arm from being the permanently deformed.

Another object of the present invention is to provide a mini jack which has a grounding contact with a curved contact section via a bending process for providing a smooth contact area thereon, thereby prohibiting the grounding contact from directly scraping or damaging a plating layer on an outer surface of a pin plug.

A further object of the present invention is to provide a grounding contact which defines a body portion and a spring arm perpendicularly bent from the body portion for preventing influencing the solder between the grounding contact and a circuit board on which the mini jack is mounted when the spring arm is elastically pressed by a pin plug.

SUMMARY OF THE INVENTION

According to an aspect of the present invention, an electrical mini jack for electrically connecting an exterior pin plug to a circuit board, comprises a plurality of signal contacts, a grounding contact, an insulative housing and a base cover. The housing defines a mating surface, a mounting surface and a plurality of walls formed therebetween. The housing includes a cavity extending through both of the surfaces for receipt of the pin plug, a pair of caves formed on the mounting surface thereof, an inclined receiving portion and a hole formed together on either of opposite walls thereof wherein the receiving portion defines thereon a first incline and a second incline. The grounding contact consists of a planar body portion, a tail portion extending through the base cover for soldering to an electrical circuit on the circuit board, a pair of positioning portions received within the caves of the housing and a spring arm perpendicularly bent with regard to the body portion for providing an increased elasticity and providing the inserted pin plug with a smooth contact area. The spring arm of the grounding contact fabricated by bending process defines thereon an inclined extension section and a curved contact section with a tip wherein the inclined extension section abuts against the first incline of the receiving portion of the housing and the tip of the contact section of the spring arm project into the cavity of the housing via the hole. Therefore, the spring arm can be located below or coplanar with an outer surface of one of the walls of the housing thereby avoiding the influence of an exterior force.

DETAILED DESCRIPTION OF THE PREFERRED EMBODIMENT

Figure 1:
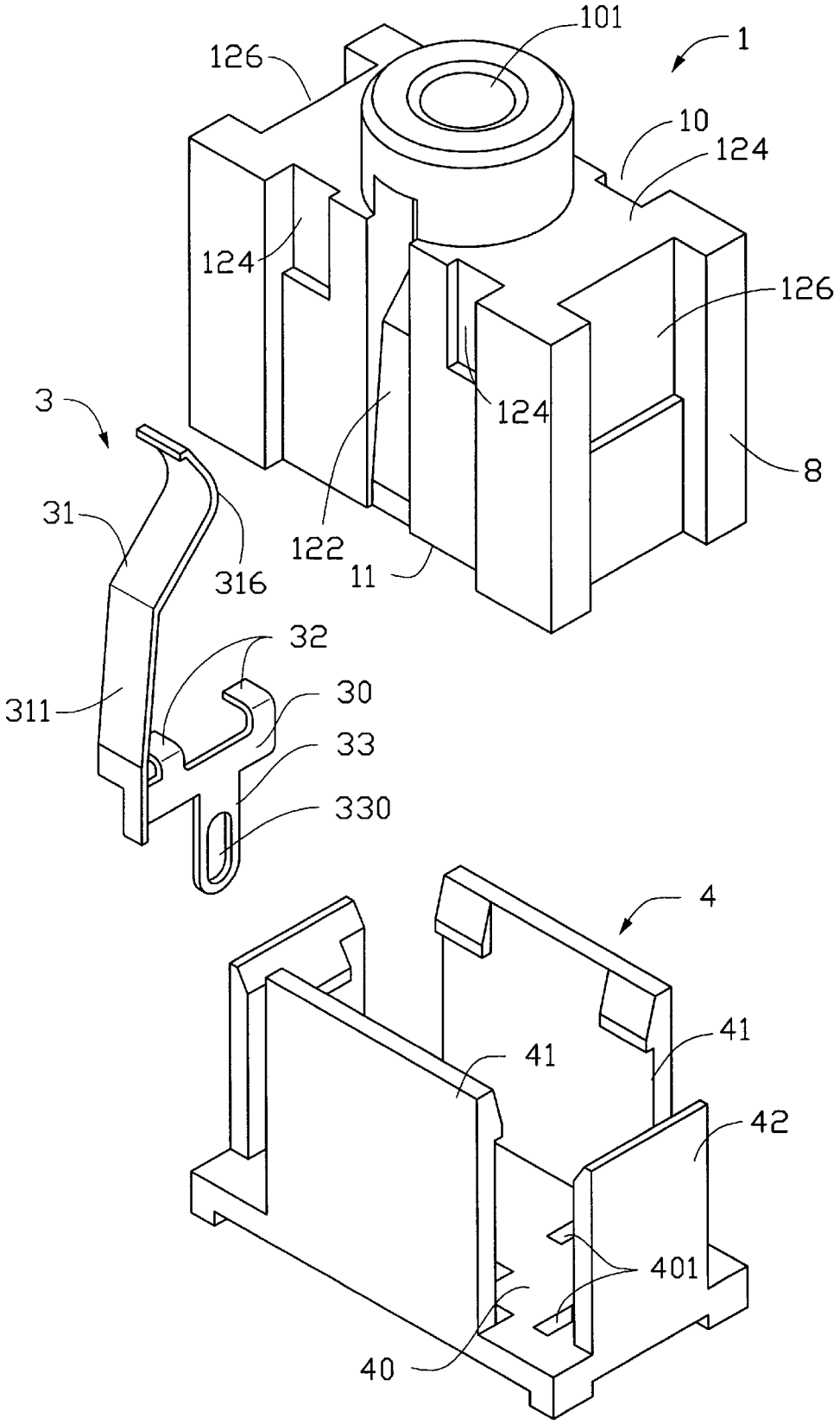
FIG. 1 is an exploded view of a mini jack in accordance with the present invention illustrating only one grounding contact.
Figure 2:
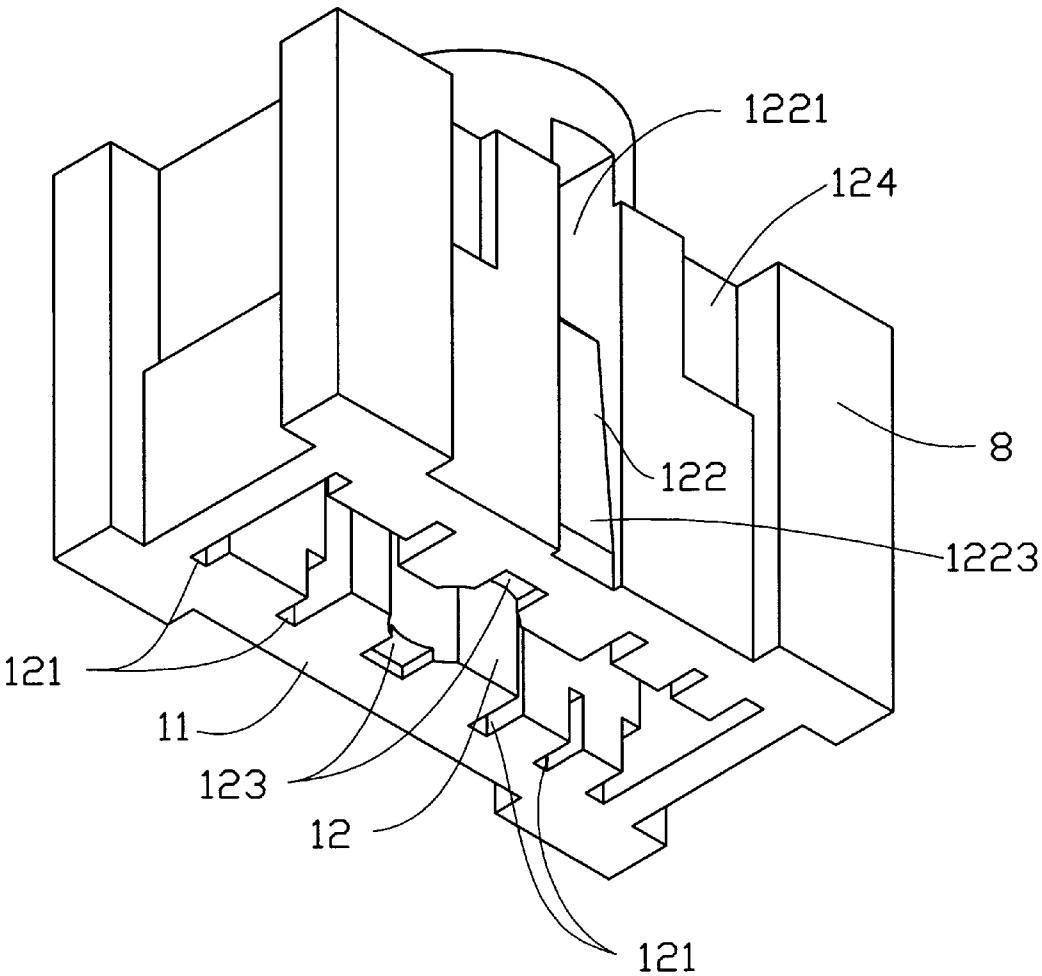
FIG. 2 is a perspective view of an insulative housing of the mini jack in accordance with the present invention.

Reference will now be made in detail with regard to the preferred embodiment of the present invention. An electrical mini jack 1 as shown in FIGS. 1 & 2 for electrically connecting an exterior pin plug 5 (see FIGS. 5 & 6) to a circuit board (not shown), includes an insulative housing 8 and a base cover 4. The insulative housing 8 is defined with a top mating surface 10 facing the mating pin plug 5, and a bottom mounting surface 11 for mounting the mini jack 1 on the circuit board wherein a mating port defines an opening (not labeled) thereon and outwardly extends in a specific distance from the mating surface for providing the pin plug 5 with an entrance of insertion. A horizontal recess 12 is defined on the bottom mounting surface 11 for providing a plurality of contacts 2, 3 (see FIGS. 3 & 4) with an entrance of insertion. A cavity 101 for receipt of the pin plug 5 extends through both of surface 10,11 and communicates between the opening of the mating port of the mating surface 10 and the horizontal recess 12 of the mounting surface 11.

Figure 5:
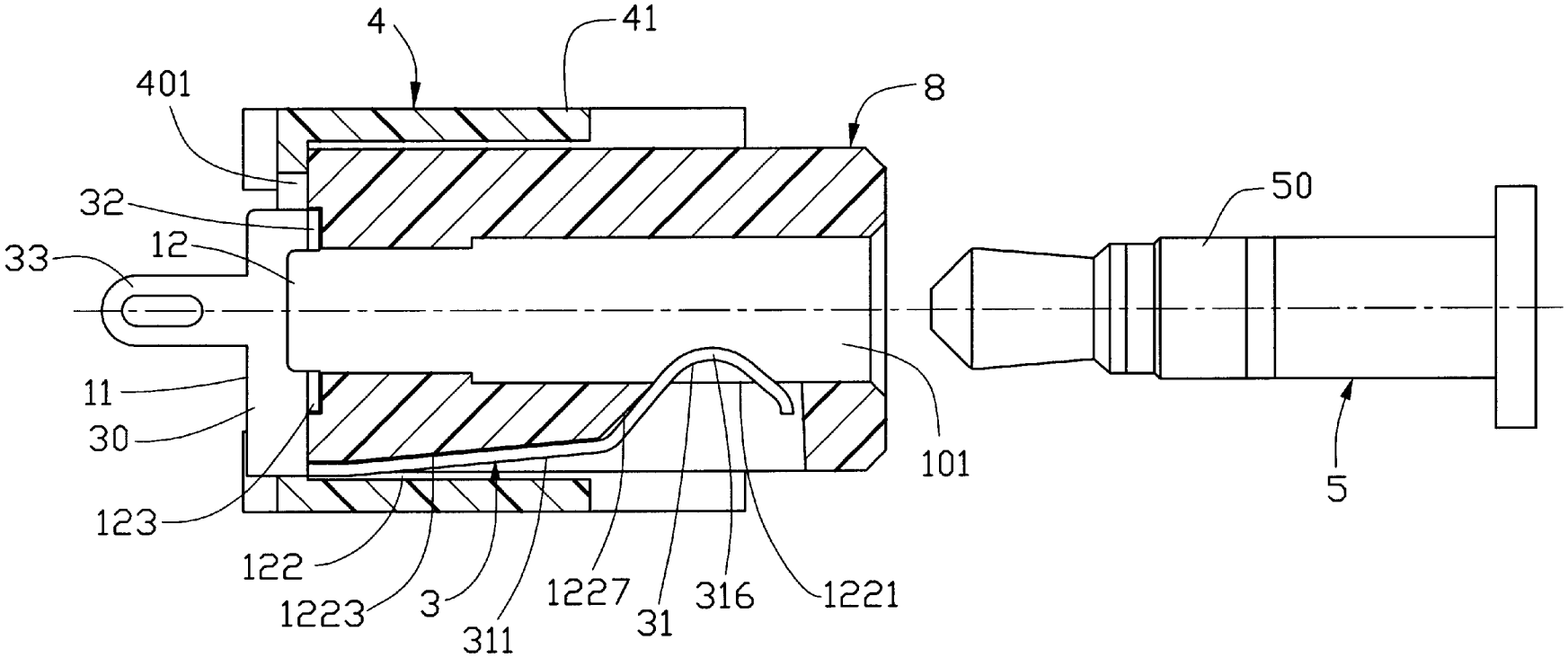
FIG. 5 is a partial cross-sectional view of the mini jack in accordance with the present invention showing an exterior pin plug to be inserted therein.
Figure 6:
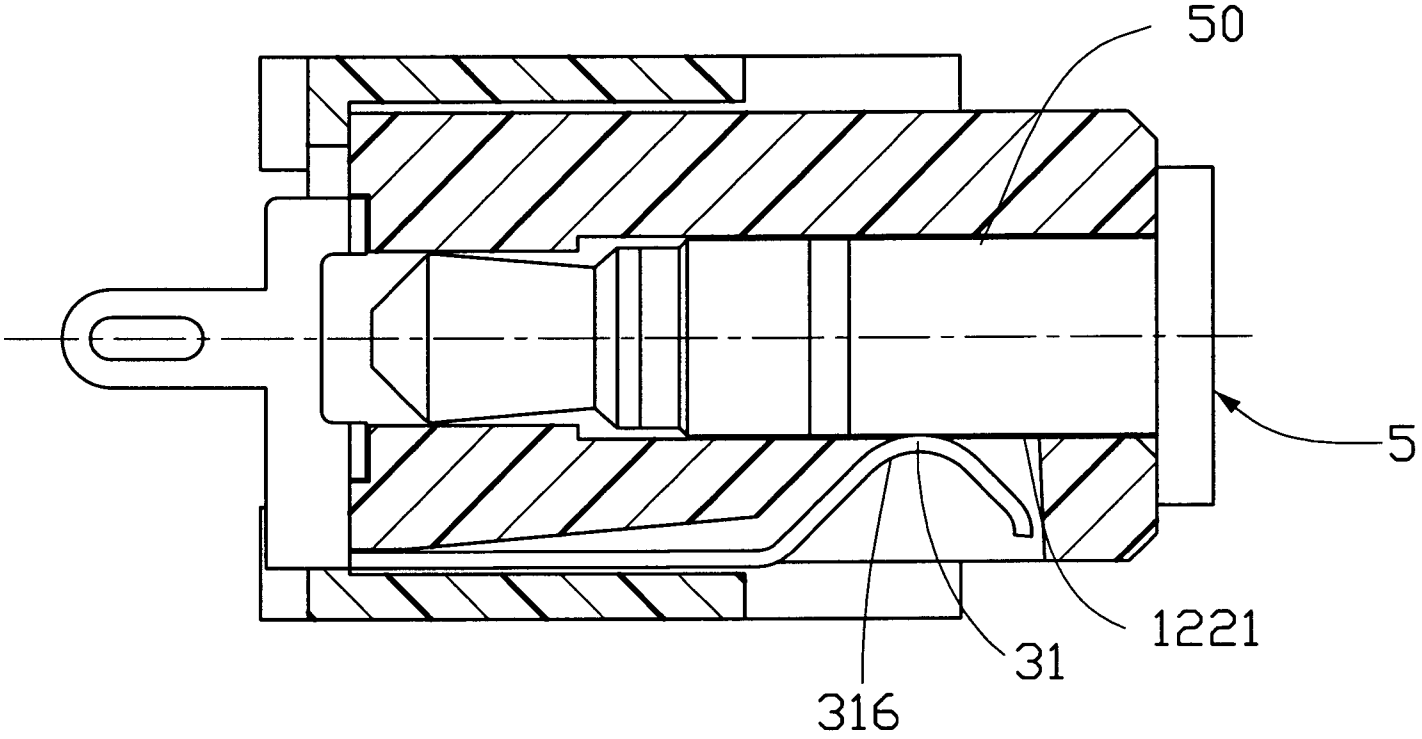
FIG. 6 is a partial cross-sectional view of the mini jack in accordance with the present invention showing that the pin plug fully inserted therein.

A pair of spaced first notches 124 are defined on an outer surface of either of a front and a rear walls of the housing 8. Similarly, a second notch 126 is defined on an outer surface of either of a right and a left walls of the housing 8 wherein all of the walls are perpendicular to and formed between said surfaces 10, 11 of the housing 8. An inwardly inclined receiving portion 122 is defined on the outer surface of either of the right and left walls and between each pair of first notches 124 and slantingly extends toward the inner of the cavity 101. The inclined receiving portion 122 consists of a first incline 1223 and a second incline 1227 which differ in slope as shown in FIGS. 5 & 6. A hole 1221 located adjacent to an end of the second incline 1227 extends through each of the front and the rear walls and perpendicularly communicates with the cavity 101 (see FIGS. 5 & 6).

Two rows of indents 121 are respectively arranged on opposite inner side which are defined with the horizontal recess 12 on the mounting surface 11 for respectively receiving the contact 2 (see FIG. 3 ) therein. A pair of spaced caves 123 are respectively defined on the central portions of the mounting surface 11.

The base cover 4 is defined with a bottom plate 40 and a pair of opposite first sidewalls 41 respectively extending vertically from opposite lateral sides of the bottom plate 40 and a pair of opposite second sidewalls 42 respectively extending vertically from opposite ends of the bottom plate 40. All of the sidewalls 41, 42 are arranged in an intermittent relationship wherein each of the first sidewalls 41 inwardly form a pair of spaced protrusions thereon for cooperating with the corresponding first notches 124 of the housing 8, and each of the second sidewalls 42 inwardly forms a protrusion (not labeled) thereon for cooperating with the corresponding second notch 126 of the housing 8. A plurality of bores 401 extends through the bottom plate 40 for receipt of said contacts 2, 3 as shown in FIGS. 3 & 4.

Figure 3:
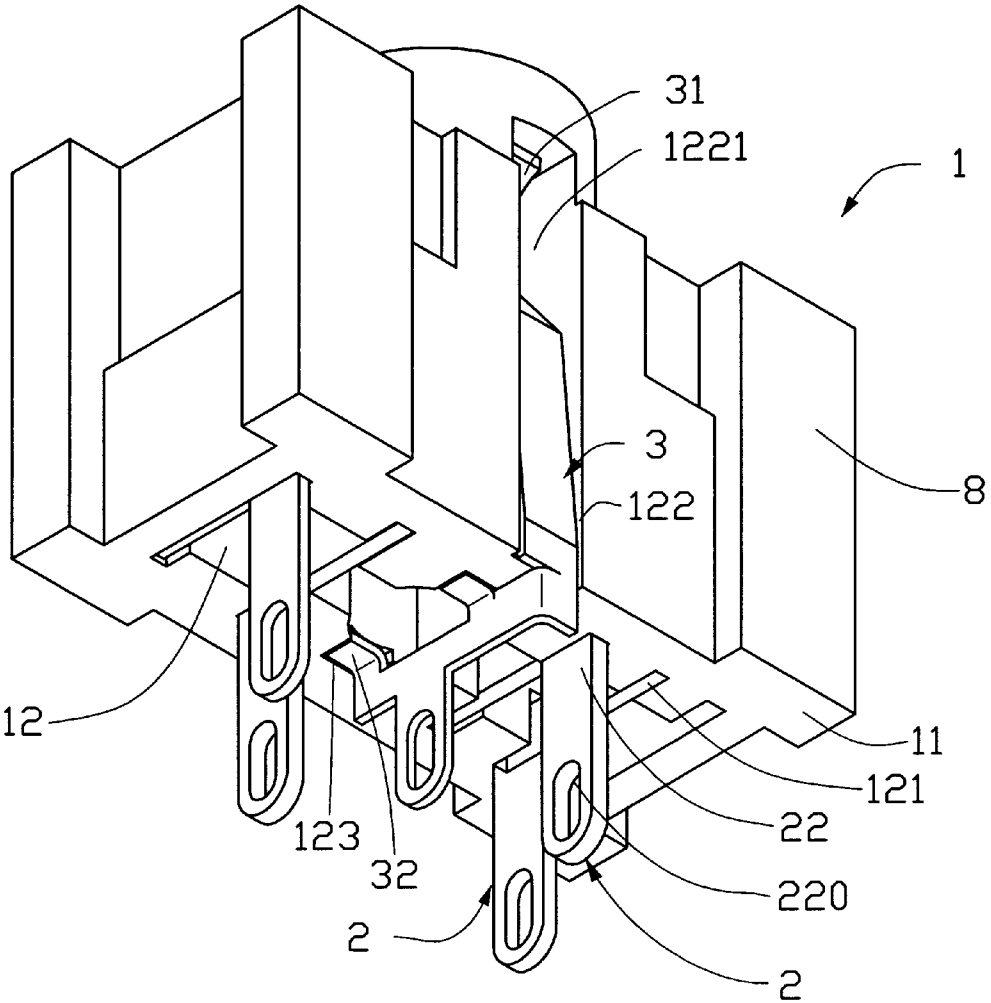
FIG. 3 is a perspective view of the insulative housing of the mini jack showing a plurality of signal contacts and a grounding contact received therein.
Figure 4:
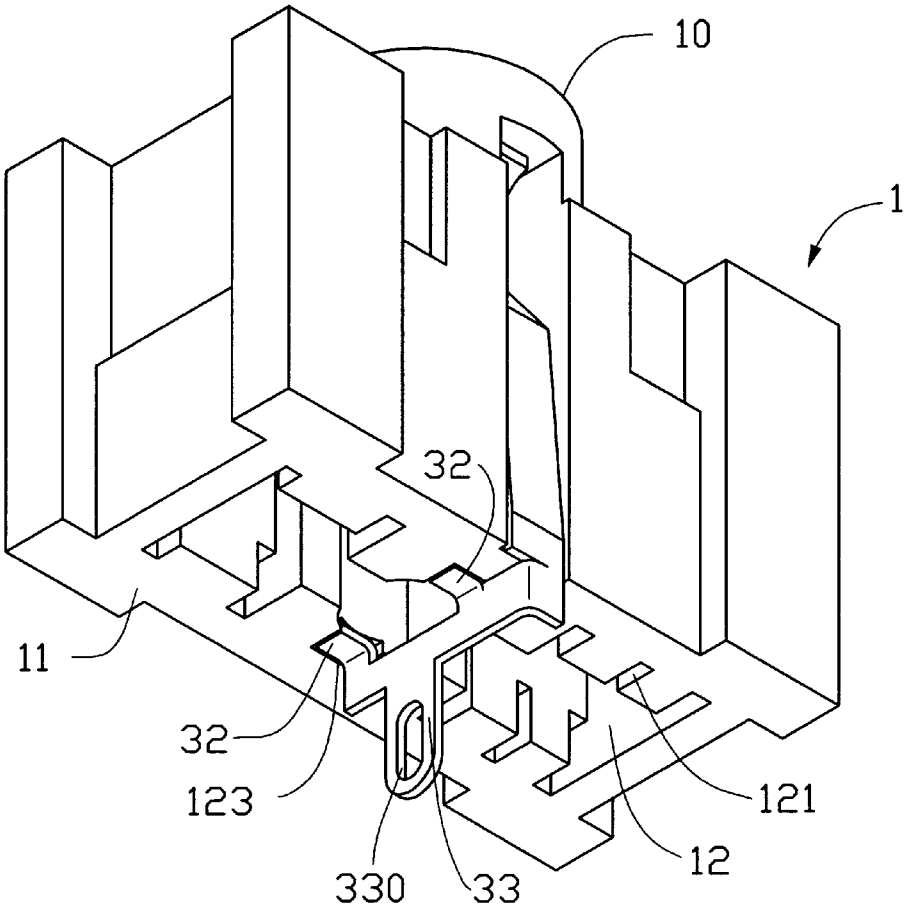
FIG. 4 perspective view of the insulative housing of the mini jack showing a grounding contact received therein.

The contacts as shown in FIGS. 1, 3 & 4 received within the housing 8 consist of a plurality of signal contacts 2 and a grounding contact 3. Since the signal contacts 2 in the present embodiment can be a conventional contact, only a tail portion 22 with an elongated slot 220 defined therein is shown for each signal contact 2 in FIG. 3. The grounding contact 3 fabricated by stamping and bending processes consists of a planar body portion 30, a spring arm 31, a pair of positioning portion 32 and a tail portion 33. The spring arm 31 functioning as a cantilever beam for electrical engagement with the pin plug 5 is bent perpendicular to an end of the body portion 30 and forms an inclined extension section 311 and an outwardly curved contact section 316 by a bending process. A tip (not labeled) is bent on a middle portion of the contact section 316. The pair of spaced positioning portions 32 are bent perpendicular to a top edge of the body portion 30 and extend outwardly in a horizontal direction perpendicular to the spring arm 31. The positioning portion 32 is adapted to accurately orient and retain the entire grounding contact 3 within the housing 5. The tail portion 33 extends downwardly from a bottom edge of the body portion 30 and defines thereon an elongated slot 330 through which a fluid solder flow to enhance the soldering engagement between the tail portion 33 of the grounding contact 3 and the circuit board.

In assembly, as shown in FIGS. 3 & 5, the positioning portions 32 of the grounding contact 3 are respectively received within the corresponding caves 123 on the mounting surface 11 of the housing 8 thereby orienting the grounding contact 3 at a specific position. Then, the spring arm 31 of the grounding contact 3 movably enters the hole 1221 along one of the inclined receiving portions 122 on the front and rear walls of the housing 8 whereby the tip of the curved contact section 316 of the spring arm 31 can project into the cavity 101 of the housing 8 for electrical engagement with the pin 50 of the pin plug 5 after insertion of the pin plug 5 into the cavity 101.

At the same time, the inclined extension section 311 of the spring arm 31 abuts against the first incline 1223 of the receiving portion 122, and a portion of the curved contact section 316 abuts against the second incline 1227 of the receiving portion 122 whereby the spring arm 3 is fully received within the receiving portion 122 of the housing 8. The spring arm 31 can be designed to be located below or coplanar with the outer surface of the right or the left wall of the housing 8 thereby avoiding the direct collision of exterior forces. The tail portion 33 of the grounding contact 3 is exposed to the outside of the horizontal recess 12 when the grounding contact 3 is exactly oriented in the housing 8. Thereafter, the protrusions of the first and the second sidewalls 41, 42 of the base cover 4 are retentively received within the corresponding first and the second notches 124, 126 of the housing 8, and the walls of housing 8 confront with the respective sidewalls 42, 42 of the base cover 4 whereby most of the housing 8 is received within a space defined with the sidewalls 41, 42 and the bottom plate 40 of the base cover 4. The body portion 30 and the tail portion 33 of the grounding contact 3 respectively extend through the corresponding bores 401 of the base cover 4 for being soldered to the circuit board, and the positioning portions 32 of the grounding contact 3 are sandwiched between the housing 8 and the base cover 4 thereby retaining the whole grounding contact 3 within the mini jack 1.

As shown in FIGS. 5 & 6, when the pin 50 of the pin plug 5 is forcedly inserted into the cavity 101 of the housing 8, a grounding section (not labeled) on the pin 50 of the pin plug 5 is electrically engaged with and presses downwardly upon the contact section 316 of the spring arm 31 of the grounding contact 3 to electrically connect the pin plug 5 to the circuit board. It is noted that the other sections arranged on the pin 50 of the pin plug 5, are electrically engaged with the corresponding signal contacts 2.

The spring arm 31 of the grounding contact 3 in accordance with the present invention is fabricated by a bending process and functions as a cantilever beam so as to provide an increased elasticity thereby preventing a permanent deformation from appearing thereon. Furthermore, the spring arm 31 is capable of providing a smooth contact area thereon to prohibit directly scraping a plating layer on an outer surface of the pin 50 of the pin plug 5. Moreover, since the configuration of the grounding contact 3 defines a body portion 30 and a spring arm 31 bent perpendicular to the body portion 30, the soldering of the tail portion 33 of the grounding contact 3 onto the circuit board is not directly influenced when the spring arm 31 is elastically pressed by the pin plug 5.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

We claim:

1. A mini jack for electrically connecting a mating pin plug to a circuit board, comprising:

an insulative housing defined with a mating surface facing the mating pin plug, a mounting surface for mounting the mini jack on the circuit board and at least a wall perpendicular to and formed between both of the surfaces wherein a cavity extends through both of the surfaces for receipt of the pin plug, and a hole extends through the wall to communicate with the cavity;

a plurality of signal contacts enclosed within the housing, each having a first tail portion; and at least one grounding contact consisting of a planar body portion, a second tail portion for soldering to an electric circuit on the circuit board, and a spring arm angularly bent with regard to the body portion and including a bent contact section with a tip which enters the cavity of the housing via the hole when the grounding contact is assembled with the housing, for providing an increased elasticity to form thereon a smooth contact area with the pin plug when the pin plug is inserted into the cavity of the housing.

2. The mini jack as described in claim 1, wherein the housing further includes a mating port with an opening extending outwardly a specific distance from the mating surface for providing the pin plug with an entrance of insertion.

3. The mini jack as described in claim 2, wherein a horizontal recess is defined on the mounting surface.

4. The mini jack as described in claim 3, wherein the cavity communicates with the opening of the mating port of the mating surface and the horizontal recess of the mounting surface.

5. The mini jack as described in claim 3, wherein at least one row of indents is arranged on one side of the horizontal recess for receiving the contacts therein.

6. The mini jack as described in claim 1, wherein the mini jack further includes a base cover which defines a bottom plate and a plurality of sidewalls vertically arranged on the bottom plate in an intermittent relationship.

7. The mini jack as described in claim 6, wherein the bottom plate of the base cover forms a plurality of bores for the tail portions of the corresponding contact.

8. The mini jack as described in claim 6, wherein each of the sidewalls inwardly form at least a protrusion thereon.

9. The mini jack as described in claim 8, wherein each wall of the housing further forms at least a notch for cooperating with the protrusion of the corresponding sidewall of the base cover for retaining the base cover on the housing.

10. A mini jack for electrically connecting a mating pin plug to a circuit board, comprising:

an insulative housing including a mating surface facing outwardly the mating pin plug, a mounting surface for mounting the mini jack on the circuit board and at least a wall perpendicular to and formed between both of the surfaces wherein a cavity extends through both of the surfaces for receipt of the pin plug, and an inclined receiving portion defined on an outer surface of the wall and slantingly extending toward the cavity;

a plurality of signal contacts enclosed within the housing, each having a first tail portion; and at least one grounding contact consisting of a planar body portion, a second tail portion for soldering to an electric circuit on the circuit board, and a spring arm fully received within the receiving portion of the housing so that the spring arm is located below or coplanar with the outer surface of the wall thereby avoiding the direct collision of exterior forces.

11. The mini jack as described in claim 10, wherein the spring arm of the grounding contact is angularly bent with regard to the body portion.

12. The mini jack as described in claim 10, wherein the inclined receiving portion is defined with a first incline and a second incline which differ in slope.

13. The mini jack as described in claim 12, wherein a hole is defined at an end of the second incline and extends through the wall of the housing to communicate with the cavity.

14. The mini jack as described in claim 12, wherein the spring arm of the grounding contact is fabricated by bending process and defined with an inclined extension section for abutting against the first incline of the receiving portion and a curved contact section for abutting against the second incline of the receiving portion when the grounding contact is assembled with the housing.

15. The mini jack as described in claim 14, wherein the contact section of the spring arm of the grounding contact forms a tip thereon which is received within the hole of the housing.

16. A mini jack, including:

an insulative housing for electrically connecting an exterior pin plug to a circuit board;

a base cover for cooperation with the housing to retentively sandwich the contact between the housing and the base cover;

a grounding contact including:

a planar body portion;

a tail portion extending downward from the body portion for soldering to an electrical circuit on the circuit board;

a spring arm received within the housing of the mini jack and angularly bent with regard to the body portion and having a contact section for electrical engagement with the inserted pin plug; and at least a positioning portion bent with regard to the body portion at a specific angle different from that of the spring arm for orienting the entire contact at a specific position in the housing of the mini jack; wherein the base cover further forms a plurality of bores for respectively receiving the tail portions and the body portions of the corresponding grounding contacts therein.

17. The mini jack described in claim 16, wherein the housing of the mini jack further includes at least a cave defined on a mounting surface of the housing for receiving the positioning portion of the contact therein.

18. The mini jack described in claim 16, wherein the spring arm of the contact is perpendicularly bent with regard to one of opposite ends of the body portion.

19. The mini jack described in claim 16, wherein the positioning portion of the contact is perpendicularly bent with regard to a top edge of the body portion.

20. The mini jack described in claim 16, wherein the tail portion of the contact further defines an elongated slot which allows a fluid solder to flow therethrough for enhancing the soldering engagement between the tail portion of the contact and the circuit board.

21. A mini jack, including:

an insulative housing for electrically connecting an exterior pin plug to a circuit board;

a grounding contact including:

a planar body portion;

a tail portion extending downward from the body portion for soldering to an electrical circuit on the circuit board;

a spring arm received within the housing of the mini jack and angularly bent with regard to the body portion and having a contact section for electrical engagement with the inserted pin plug; and at least a positioning portion bent with regard to the body portion at a specific angle different from that of the spring arm for orienting the entire contact at a specific position in the housing of the mini jack; wherein the spring arm is perpendicularly bent with regard to one of opposite ends of the body portion.

22. A mini jack, including:

an insulative housing for electrically connecting an exterior pin plug to a circuit board;

a grounding contact including:

a planar body portion;

a tail portion extending downward from the body portion for soldering to an electrical circuit on the circuit board;

a spring arm received within the housing of the mini jack and angularly bent with regard to the body portion and having a contact section for electrical engagement with the inserted pin plug; and at least a positioning portion bent with regard to the body portion at a specific angle different from that of the spring arm for orienting the entire contact at a specific position in the housing of the mini jack; wherein the tail portion of the contact further defines an elongated slot which allows a fluid solder to flow therethrough for enhancing the soldering engagement between the tail portion of the contact and the circuit board.

* * * * *